United States Patent [19]

Dana

[11] 4,314,318

[45] Feb. 2, 1982

[54] LIGHT-REFLECTING DEVICE

[76] Inventor: James Dana, 102 Browns Rd., Nesconset, N.Y. 11767

[21] Appl. No.: 188,357

[22] Filed: Sep. 18, 1980

[51] Int. Cl.[3] ..... F21V 11/00

[52] U.S. Cl. ..... 362/240; 362/238; 362/301; 362/346

[58] Field of Search ..... 362/238, 240, 297, 301, 362/343, 346

[56] References Cited

U.S. PATENT DOCUMENTS

| | | | |
|---|---|---|---|
| 3,309,514 | 3/1967 | Levy et al. | 362/240 X |
| 3,609,339 | 9/1971 | Smith | 362/301 X |
| 3,818,216 | 6/1974 | Larraburu | 362/301 X |
| 4,074,126 | 2/1978 | Dey | 362/297 |
| 4,225,906 | 9/1980 | Gulliksen et al. | 362/238 X |
| 4,250,537 | 2/1981 | Roegner et al. | 362/343 X |
| 4,254,336 | 3/1981 | Rostler | 362/301 X |

*Primary Examiner*—Peter A. Nelson

[57] ABSTRACT

A light reflector, preferably for at least three different color light sources, used in a cluster arrangement, which beams the rays of the input light sources to the target or area destined for illumination in closely adjacent and parallel relation, so that the visually perceived color of the light beam is a function of the mixture of the input light source, and can be readily varied over a wide range by varying the intensity and amounts of the individual light inputs.

6 Claims, 6 Drawing Figures

LIGHT-REFLECTING DEVICE

The present invention relates to devices for producing colored-light effects, and primarily a variable color light beam, using the known technique of beaming the light rays close together so as to produce a resultant color in said light beam which is a mixture of the input colors, and more particularly to improvements for such a device which significantly contribute to the light beam-producing effectiveness and efficiency thereof.

As exemplified by the technique described in prior U.S. Pat. No. 1,219,514, the perceived color of different colored light rays reflected along closely adjacent and parallel paths is a function of the mixture thereof, and thus affords an opportunity to vary the resulting light beam color by varying one or more of the colors, intensities or the like of the light inputs. This technique, however, is undoubtedly not in greater use in providing colored-light effects in theatres, discotheques, or in similar obviously appropriate situations, because of the limitations, optical and otherwise, imposed by the prior art light reflecting component. In the prior patent above noted, which is typical, each light input source is reflected by one mirror or surface, and thus this mirror must be somewhat large in size and the light source cooperating therewith placed in facing relation thereto in a cramped, and somewhat restricted, circumscribed angular relation. In contrast, and as will be more readily apparent as the description proceeds, each light source in the three-light input source of the within inventive system occupies a circumferential extent of 120 degrees, and thus can be readily large in size, with the attendant advantages of producing a higher wattage light and providing other benefits.

Broadly, it is an object of the present invention to provide an improved light-reflecting component for use in a variable color light beam-producing device overcoming the foregoing and other shortcomings of the prior art. Specifically, it is an object to reflect the light rays of each color light input source using a plurality of mirrors occupying positions circumscribing a reasonably large angle, thus permitting a correspondingly reasonably large light source to be positioned, as it is required to be, in facing relation to the said mirrors, to thereby obviate the prior art cramping and imposed restrictions on the primary or input light sources which now characterize known colored light beam-producing systems.

In a preferred embodiment using the selected colors red, blue, and green, a device for beaming a resultant color light to a target which is a function of the mixing of said red, blue and green light sources demonstrating objects and advantages of the present invention has said red, blue, and green light sources circumferentially spaced 120 degrees apart, and includes a plurality of light-reflecting members in facing relation to said light sources operatively effective to beam light impinging thereon from said light sources to said target along closely parallel paths to thereby contribute to a visually-perceived color which is the resultant mixture of said red, blue, and green lights. The crux of the within technical contribution over the prior art resides in each light-reflecting member consisting of a body having a vertically oriented central axis and a cooperating arrangement of three rectangularly shaped mirrors, each of which is firstly disposed in facing relation to one said light source at an angular orientation in relation thereto selected to reflect light from said source impinging thereon along a path parallel to said body central axis, and secondly with said long dimension of each said rectangular mirror being disposed at a perpendicular orientation to said body central axis and subtending a circumferential extent of 120 degrees. The three just noted mirrors are supported on an upper end of the body of the light-reflecting member with the uppermost three corners of said mirrors joined at a common location and with the two sides diverging outwardly therefrom of each said mirror being joined to the two corresponding sides of each of the other two mirrors, to thereby form for each mirror two ridges in uppermost locations at the juncture of their sides in joined relation to each other. The result is that ridges of each mirror confine for impingement thereon only the light from the source that is in facing relation thereto. The overall or cooperating effect of a plurality or cluster of the just described light-reflecting members is to reflect numerous light rays in the colors red, blue, and green along paths in closely adjacent and parallel relation, thereby enabling a wide range of variation in the resultant color of the light beam made up of these light rays.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a perspective view of a prior art light beam-producing arrangement having cooperating light sources which are mixed during use to provide a resultant color to said light beam;

Remaining FIGS. 2–5 illustrate an improved arrangement over that of FIG. 1, the same also providing a resultant color light beam, but more effectively and efficiently. More particularly, FIG. 2 is a perspective view of a light-reflecting component of the within improved arrangement;

Associated with FIG. 2 is an instruction diagram, herein designated FIG. 2A, which illustrates the construction of each light-reflecting member that is part of the component of FIG. 2. Moreover, to the extent that an "optical illusion" interferes with an understanding of what is depicted in FIG. 2, the instruction diagram of FIG. 2A provides a supplementing explanation thereof without said interference;

FIG. 5 is a perspective view of the inventive device hereof in a contemplated end use to provide a spotlight for a theatrical production or the like.

Figure 4:
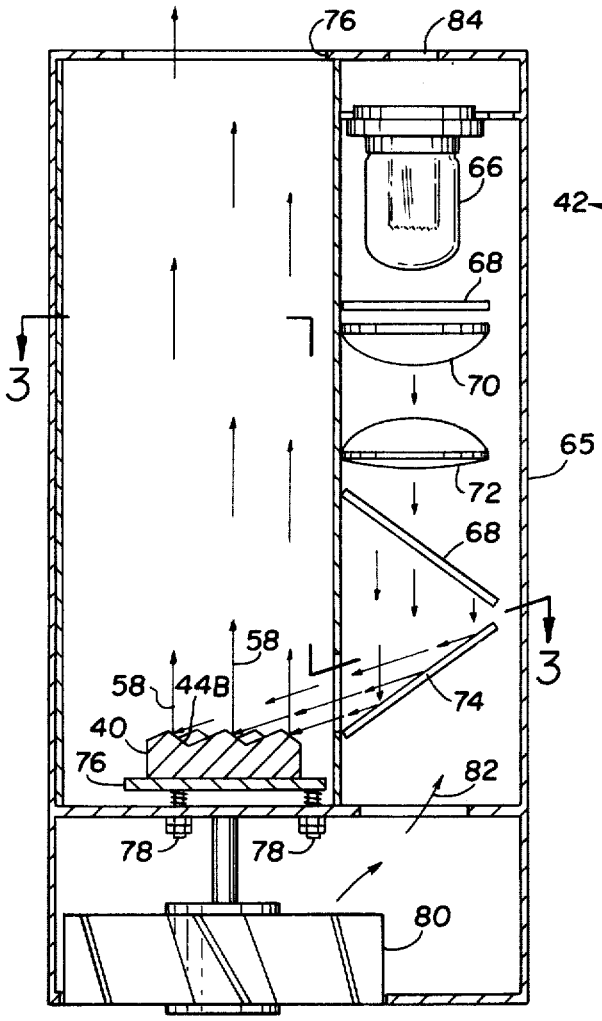
FIG. 4 is another sectional view of the within device taken along line 4—4 of FIG. 3, showing further structural details.

It is already well known according to prior U.S. Pat. No. 1,219,514 and other such patents, that a beam of light having a desired color can be achieved by mixing the individual colors of so-called primary light sources. Thus, as shown for example in FIG. 1, light from incandescent electric lamps 10, 12, and 14 can be directed through red, yellow, and green lenses respectively designated 16, 18, and 20, or other lenses selected to provide other colors, and be made to impinge upon a prior art light-reflecting mirror, generally designated 21. According to the prior art technique illustrated in FIG. 1, mirror 21 has three surfaces, individually and collectively designated 22, at an appropriate angular orientation so that the light impinging thereon will project this light along a converging light path 24 towards the target or location destined to be illuminated by the light. Typically, a projected light beam will be directed through a diffusing lens 26 and objective lens 28. The importance of the FIG. 1 prior art arrangement is that the light from the individual sources that is reflected towards the target by the mirror 21 forms a light beam 30 which has a perceivable resultant color provided by the input colors which, in this instance, are red, yellow, and green. As should be readily appreciated, the perceived color of light beam 30 can be made to vary throughout a wide range by varying the intensities or amounts of the individual lights of the system.

Figure 2:
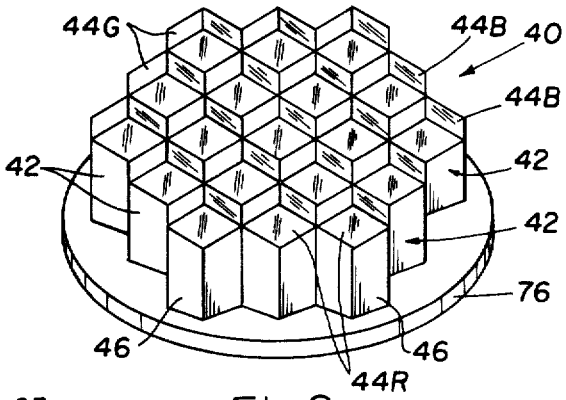
Figure 1:
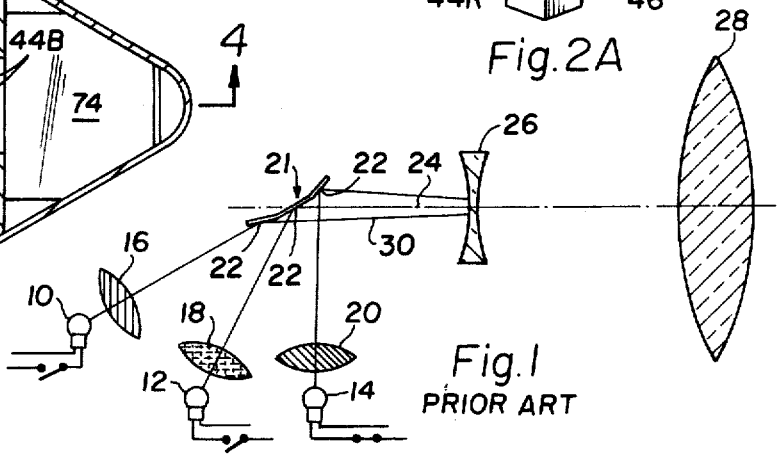
Fig.1 PRIOR ART

With the above understanding of the state of the prior art as just generally described in connection with FIG. 1, it will be understood that the inventive contribution hereof consists primarily in a significantly improved light-reflecting component, generally designated 40 and illustrated in isolated perspective in FIG. 2. Because the line drawing of the component or light-reflecting member 40 inadvertently gives rise to an "optical illusion", the content of FIG. 2 can perhaps best be understood by referring to the associated instruction diagram of FIG. 2A which illustrates the individual units, designated 42, which in a cluster-like type arrangement as illustrated in FIG. 2 cooperate with each other in providing the light-reflecting member 40. This is, each unit 42 is identically constructed and such construction will now be described in connection with the instruction diagram of FIG. 2A. This construction includes three light-reflecting surfaces which during use are respectively in facing relation to sources of red, blue, and green lights. The reflecting surface for the red light is designated 44R, for the blue light 44B, and for the green light 44G. The surfaces just identified are actually machined and provided as polished light-reflecting surfaces at the upper end of the body 46 of each unit 42 although, in FIG. 2A, solely to assist in explaining the structural features thereof, these surfaces are shown in isolated perspective about the unit 42. Using said isolated perspective makes it easier to explain that each surface, taking surface 44R as an example, is of a rectangular shape and is disposed with the long dimension thereof oriented generally perpendicularly to a central vertical axis 48 of unit 42, and with each surface oriented as just indicated occupying a circumferential extent 50 of approximately 120 degrees about the vertical central axis 48. In other words, the three surfaces 44R, 44B, and 44G are circumferentially arranged about the vertical axis 48 so that each is in facing relation to its cooperating light source located at spaced intervals of 120 degrees about the cooperating cluster of units 42.

Figure 2A:
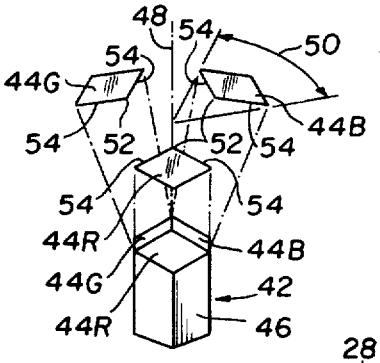

Still referring to the instruction diagram of FIG. 2A, it will be understood that the uppermost corner of each of the light-reflecting surfaces, individually and collectively designated 52, form a common juncture or a point, similarly designated 52, which in the actual construction of each unit 42 lies on the vertical center line 48. To achieve this, the opposite outwardly diverging sides 54 of each surface are joined to its adjacent counterpart. The result, again as illustrated in connection with light-reflecting surface 44R, is to form at the top of each unit 42 two ridge lines 56 diverging outwardly from the common point 52. Still using surface 44R as an example of the functioning of all of the surfaces, the significance of the ridge lines 56 is that the red light source facing the surface 44R is confined by the ridges 56 to impinge only on surface 44R and all counterparts thereof of the cluster of units 42. That is, the red light source cannot bend over the ridge lines 56 and impinge on either of the other light-reflecting surfaces 44B or 44G. Rather, only the blue light source in facing relation to the light surfaces of 44B can impinge on these surfaces, and similarly, only the green light in facing relation to the light surfaces 44G can impinge on this array of surfaces.

At this point in the description it is convenient to refer to FIG. 4 which illustrates what the effect is of the impingement of the light on the cluster of units 42 which, as already indicated, cooperate with each other to constitute the light-reflecting member 40. Taking now the arrangement or array of surfaces in facing relation to the blue light source and thus the surfaces 44B, it will be understood that these surfaces are provided in the tops of the units 41 at an angular orientation selected to reflect the impinging light thereon along paths, individually and collectively designated 58, which will be understood to be approximately parallel to the central vertical axis 48 of each of the units 42. This is readily achieved by merely inclining each of the surfaces 44R, 44B, and 44G in relation to the vertical axis 48 at an appropriate angle, which in this instance is an angle of approximately 54 degrees. In summary, therefore, the blue light which is reflected by each surface 44B is directed towards a selected location or target along light paths 58 which are closely adjacent and approximately parallel to each other.

Since the other light reflecting surfaces 44R and 44G are an integral part of each of the units 42, it should be readily understood that these surfaces produce the same effect as just described in connection with the surfaces 44B but in connection with the red and green lights, respectively. That is, the arrangement of surfaces 44R in facing relation to the red light produces plural red light rays reflected along the light paths 58 which also are adjacent and in parallel relation to each other, while the cooperative arrangement of surfaces 44G produce green light rays in adjacent and parallel relation and also directed along light paths 48 towards the target or other selected location.

At this point in the description it is pertinent to note that since the surfaces 44R, 44B, and 44G are embodied in each of the units 42 in adjacent position to each other, being in fact joined at the common point 52 and along their respective sides 54, the result of this construction is to provide with respect to each unit 42 a reflected red, blue, and green light beam that is projected along light paths 58 in closely adjacent and parallel relation. This functioning of each unit 42 is, of course, duplicated by each of the other units 42, with the result that the cluster-type arrangement thereof as illustrated in FIG. 2 is effective to produce a resultant light beam, designated 58 in FIG. 5, which has a perceived color that is a function of the mixing of the individual light beams that impinge upon and are reflected by the light-reflecting member 40. Moreover, the perceived color of light beam 58 can be varied throughout a wide range by varying, using a rheostat 60 or other such control, the intensity of each of the individual input colors red, blue, or green, or other selected color inputs.

Figure 5:
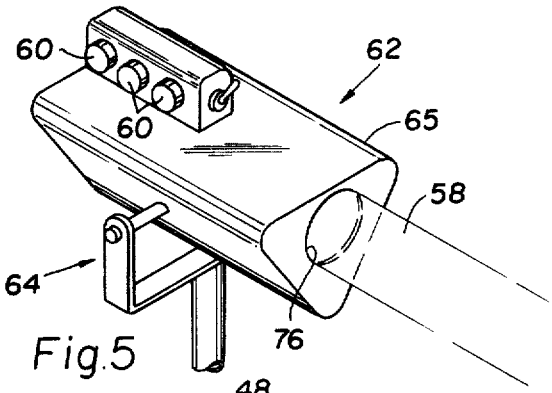
Figure 3:
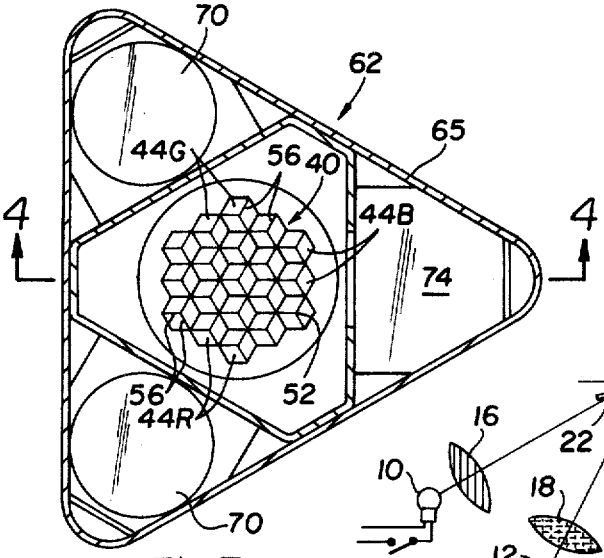
FIG. 3 is a sectional view of the within light beam-producing device taken along line 3—3 of FIG. 4.

For completeness' sake, the preferred construction of a light beam producing device, generally designated 62 which, in practice, uses the improved light-reflecting member 42 of the present invention, will now be described with particular reference to FIGS. 3, 4 and 5. Device 62 includes an outer housing 65 appropriately mounted to partake of two degrees of rotative movement in a gimbal 64. As illustrated in the cross-sectional views of FIGS. 3 and 4, the selected three light sources are circumferentially spaced approximately 120 degrees from each other within the housing 64. Assuming that the blue light source is the one illustrated in FIG. 4, the same includes an incandescent light or lamp 66 which produces blue light by having all other light frequencies filtered out when the light thereof is passed through the blue filters 68. Between the filters 68 the optics of the system will typically dictate use of the light dispersing and gathering lenses 70 and 72, respectively. Appropriately mounted in an intercepting position along the path of light of the lamp 66 is a mirror 74 which reflects the blue light onto the surfaces 44B at an appropriate angle of incidence so that the surfaces 44B, as already described, are effective in reflecting the blue light along paths 58 which are substantially parallel to the vertical central axis 48 of each of the units 42. Following the path 58, the light exits through opening 76 as a resultant light beam 58 which has a perceived color that is a result of the mixing of the individual light inputs red, blue, and green.

To assist in obviating any misalignment in the block or cluster 40 of the individual units 42, the same is mounted on a disc 76 that has threadable means 78 for making adjustments in the position thereof. As is typical of spotlights, the preferred embodiment of the device 62 also includes a blower 80 which directs a stream of cooling air 82 in heat exchange past each lamp 66 and out of an outlet opening 84.

From the foregoing description it should be readily appreciated that the light-producing device 62 hereof has significant improvements over the prior art due primarily to the use of the improved light-reflecting component or member 40. Unlike its prior art counterpart 21 as described in connection with the prior art set-up of FIG. 1, the cluster 40 of the units 42 is adapted to receive each of the individual lights throughout a circumferential extent of 120 degrees and will more effectively reflect this light by virtue of the use of a multitude of light-reflecting surfaces. This is in contrast to the use in the prior art of three large surface area mirrors, one for each of the individual three light inputs.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

I claim:

1. A device for beaming a resultant color light to a target which is a function of the mixing of red, blue, and green light sources comprising, in combination, red, blue, and green light sources circumferentially spaced 120 degrees apart, and a plurality of light-reflecting members in facing relation to said light sources operatively effective to beam light impinging thereon from said light sources to said target along closely parallel paths to thereby contribute to a visually-perceived color which is said resultant mixture of said red, blue, and green lights, each said light-reflecting member consisting of a body having a vertically oriented central axis, a cooperating arrangement of three rectangularly shaped mirrors each disposed in facing relation to one said light source at an angular orientation in relation thereto selected to reflect light from said source impinging thereon along a path parallel to said body central axis, said long dimension of each said rectangular mirror being disposed at a perpendicular orientation to said body central axis and subtending a circumferential extent of 120 degrees, and said three mirrors being supported on an upper end of said body with the uppermost three corners of said mirrors joined at a common location and the two sides diverging outwardly therefrom of each said mirror being joined to said corresponding two sides of each of said other two mirrors to thereby form for each mirror two ridges in uppermost locations at the juncture of said sides in joined relation to each other, whereby said ridges of each said mirror confine for impingement thereon only the light from said source in facing relation thereto such that said cooperating effect of said plural light-reflecting members is to reflect light in the colors red, blue, and green along paths in closely adjacent and parallel relation.

2. A device for beaming red, blue, and green lights in a resultant color light beam as claimed in claim 1 including means for individually varying the intensity of each said light.

3. A device for beaming red, blue, and green lights in a resultant color light beam as claimed in claim 2 wherein each light source is operatively arranged to direct the light thereof from a clearance position along a path parallel to the path of the resultant light beam and in a direction opposite thereto, and a mirror is disposed in said light path to reflect said light onto said plurality of light-reflecting members.

4. A device for beaming a resultant color light to a target which is a function of the mixing of a first, a second, and a third light source comprising, in combination, a first, a second, and a third light source circumferentially spaced 120 degrees apart, and a plurality of light-reflecting members in facing relation to said light sources operatively effective to beam light impinging thereon from said light sources to said target along closely parallel paths to thereby contribute to a visually-perceived color which is said resultant mixture of said first, second, and third lights, each said light-reflecting member consisting of a body having a vertically oriented central axis, a cooperating arrangement of three rectangularly shaped mirrors each disposed in facing relation to one said light source at an angular orientation in relation thereto selected to reflect light from said source impinging thereon along a path parallel to said body central axis, said long dimension of each said rectangular mirror being disposed at a perpendicular orientation to said body central axis and subtending a circumferential extent of 120 degrees, and said three mirrors being supported on an upper end of said body with the uppermost three corners of said mirrors joined at a common location and the two sides diverging outwardly therefrom of each said mirror being joined to said corresponding two sides of each of said other two mirrors to thereby form for each mirror two ridges in uppermost locations at the juncture of said sides in joined relation to each other, whereby said ridges of each said mirror confine for impingement thereon only the light from said source in facing relation thereto such that said cooperating effect of said plural light-reflecting members is to reflect light in the colors of said sources along paths in closely adjacent and parallel relation.

5. A device for beaming a resultant color light to a target which is a function of the mixing of a first, a second, and a third light source comprising, in combination, a first, a second, and a third light source circumferentially spaced 120 degrees apart, and a plurality of light-reflecting members in facing relation to said light sources operatively effective to beam light impinging thereon from said light sources to said target along closely parallel paths to thereby contribute to a visually-perceived color which is said resultant mixture of said first, second, and third lights, each said light-reflecting member consisting of a body having a vertically oriented central axis, a cooperating arrangement of three mirrors having a triangularly shaped upper portion each disposed in facing relation to one said light source at an angular orientation in relation thereto selected to reflect light from said source impinging thereon along a path parallel to said body central axis, said long dimension of each said mirror being disposed at a perpendicular orientation to said body central axis and subtending a circumferential extent of 120 degrees, and said three mirrors being supported on an upper end of said body with the uppermost three corners of said mirrors joined at a common location and the two sides diverging outwardly therefrom of each said mirror being joined to said corresponding two sides of each of said other two mirrors to thereby form for each mirror two ridges in uppermost locations at the juncture of said sides in joined relation to each other, whereby said ridges of each said mirror confine for impingement thereon only the light from said source in facing relation thereto such that said cooperating effect of said plural light-reflecting members is to reflect light in the colors of said sources along paths in closely adjacent and parallel relation.

6. A device for beaming a resultant color light to a target which is a function of the mixing of at least a first, a second, and a third light source comprising, in combination, at least three light sources equally circumferentially spaced apart, and a plurality of light-reflecting members in facing relation to said light sources operatively effective to beam light impinging thereon from said light sources to said target along closely parallel paths to thereby contribute to a visually-perceived color which is said resultant mixture of said lights, each said light-reflecting member consisting of a body having a vertically oriented central axis, a cooperating arrangement of at least three rectangularly shaped mirrors each disposed in facing relation to a selected one of said light sources at an angular orientation in relation thereto selected to reflect light from said source impinging thereon along a path parallel to said body central axis, said long dimension of each said rectangular mirror being disposed at a perpendicular orientation to said body central axis and subtending a circumferential extent which is substantially equal to the spacing between said light sources, and said three and more mirrors being supported on an upper end of said body with the uppermost corners of said mirrors joined at a common location and the two sides diverging outwardly therefrom of each said mirror being joined to said corresponding two sides of each of said other mirrors to thereby form for each mirror two ridges in uppermost locations at the juncture of said sides in joined relation to each other, whereby said ridges of each said mirror confine for impingement thereon only the light from said source in facing relation thereto such that said cooperating effect of said plural light-reflecting members is to reflect light in the colors of said sources along paths in closely adjacent and parallel relation.

* * * * *